US006351543B1

(12) United States Patent
Lenhard-Backhaus et al.

(10) Patent No.: US 6,351,543 B1
(45) Date of Patent: Feb. 26, 2002

(54) MICRO-MICROPHONE

(75) Inventors: Hugo Lenhard-Backhaus, Vienna; Richard Pribyl, Fischamend, both of (AT)

(73) Assignee: AKG Acoustics GmbH, Vienna (AT)

( * ) Notice: Subject to any disclaimer, the term of this patent is extended or adjusted under 35 U.S.C. 154(b) by 0 days.

(21) Appl. No.: 09/528,311

(22) Filed: Mar. 17, 2000

(30) Foreign Application Priority Data

Mar. 23, 1999 (AT) ..... 545/99

(51) Int. Cl.[7] ..... H04R 25/00

(52) U.S. Cl. ..... 381/360; 381/355; 381/361; 381/364

(58) Field of Search ..... 381/355, 357, 381/358, 360, 361, 364, 366, 367, 368, FOR 147

(56) References Cited

U.S. PATENT DOCUMENTS 5,272,758 A * 12/1993 Isogami et al. ..... 381/355
5,673,330 A * 9/1997 Chang ..... 381/355
5,781,644 A * 7/1998 Chang ..... 381/361
6,091,828 A * 7/2000 Akino et al. ..... 381/355
6,130,952 A * 7/2000 Akino et al. ..... 381/361

* cited by examiner

*Primary Examiner*—Curtis Kuntz
*Assistant Examiner*—Suhan Ni
(74) *Attorney, Agent, or Firm*—Friedrich Kueffner

(57) ABSTRACT

A micro-microphone, for attachment to the clothing or directly to the body of a user, has a housing with a housing mantle, an end plate connected to a first end of the housing mantle, and a bottom plate connected to the second end of the housing mantle. The housing mantle has one or more openings, each covered by a membrane positioned external to the housing mantle. The housing and the membranes thus define an inner hollow space inside the housing. A flaccid diaphragm is connected externally to a portion of the housing and encloses together with the portion of the housing a compensation chamber. The flaccid diaphragm seals the compensation chamber moisture-tightly. A component of high acoustic impedance connects the inner hollow space inside the housing to the compensation chamber. Pressure compensation is thus realized while moisture is excluded from the interior of the microphone.

10 Claims, 1 Drawing Sheet

MICRO-MICROPHONE

BACKGROUND OF THE INVENTION

1. Field of the Invention

The invention relates to small and smallest microphones (micro-microphones), which are worn on the clothing or often directly on the body, for example, in the hair, of the user.

2. Description of the Related Art

Such micro-microphones comprise commonly one, less commonly, two or more membranes which are usually placed over cutouts in the mantle of the cylindrical microphone. This configuration provides an inner hollow space between the end plate, the bottom plate, and the housing mantle with the openings covered by the membranes. This inner hollow space is required and essential for the acoustic properties of the microphone.

It is important in connection with this inner hollow space that it has a pressure that is as close as possible to the barometric pressure of the ambient in order to maintain the membranes, when at rest, in a predetermined and precisely defined position as well as in a defined tension state.

In order to achieve this goal, it has been common practice to provide small openings usually within the area of the membrane attachment but also directly within the membranes. These small openings then allow pressure compensation.

However, due to the special applications of these microphones, it happens frequently that moisture enters the inner hollow space through these openings and condenses there, thus causing problems for the membrane and the other microphone components. One has to take into consideration that these microphones, for example, during song performances or theater or musical performances, are worn by the singers and actors directly on their skin or in the hair. These types of microphones are thus subjected to much greater adverse effects than conventional microphones. This is also evidenced in that the average service life of such microphones in the theater is usually not even a month so that there exists a strong economical interest to solve the aforementioned problems.

It must be taken into consideration that the length as well as the diameter of the completely assembled microphone is only a few millimeters.

SUMMARY OF THE INVENTION

It is an object of the present invention to increase the average service life of microphones of the aforementioned kind while maintaining their small size and their acoustic properties.

In accordance with the present invention, this is achieved in that the inner hollow space is connected by a component of high acoustic impedance with a compensation chamber that is moisture-tightly sealed by a flaccid diaphragm relative to the ambient.

With this measure it is achieved that a complete closure of the microphone interior relative to the exterior (ambient) is realized. Furthermore, by providing a component with high acoustic impedance, which functions in the present case similarly to a low-pass filter, the acoustic properties of the inner hollow space and thus of the entire microphone will not change because, for the frequencies to be transmitted during operation, the component will act similarly to a closed wall as a result of its high impedance.

Moreover, the compensation chamber and the flaccid diaphragm ensure that the ambient pressure will deform the diaphragm to such an extent that the barometric ambient pressure is always present in the interior of the microphone.

As a component of high acoustic impedance it is preferred to employ a pressure compensation tube having an inner diameter in the range of approximately 70 $\mu$m and a length of 3 to 4 mm. However, it is also possible to provide a stopper or the like made of open-pore foamed material or the like. It should be noted though that the tube is the preferred embodiment with respect to acoustic properties.

The flaccid closure diaphragm must essentially only fulfill the requirements of being impermeable to moisture and of being as flaccid as possible, i.e., being formed without tension and being mounted without tension. It is provided only to separate and protect the compensation chamber from the ambient.

It is possible to employ conventional materials as they are used in the field of electro-acoustics for the novel components employed according to the invention. The flaccid diaphragm, for example, can be made of polycarbonate, polyurethane, rubber or elastomer, but also of metal foils. The tube can be made of corrosion-resistant materials such as German silver, stainless steel, or plastic.

DESCRIPTION OF THE PREFERRED EMBODIMENTS

Figure 1:
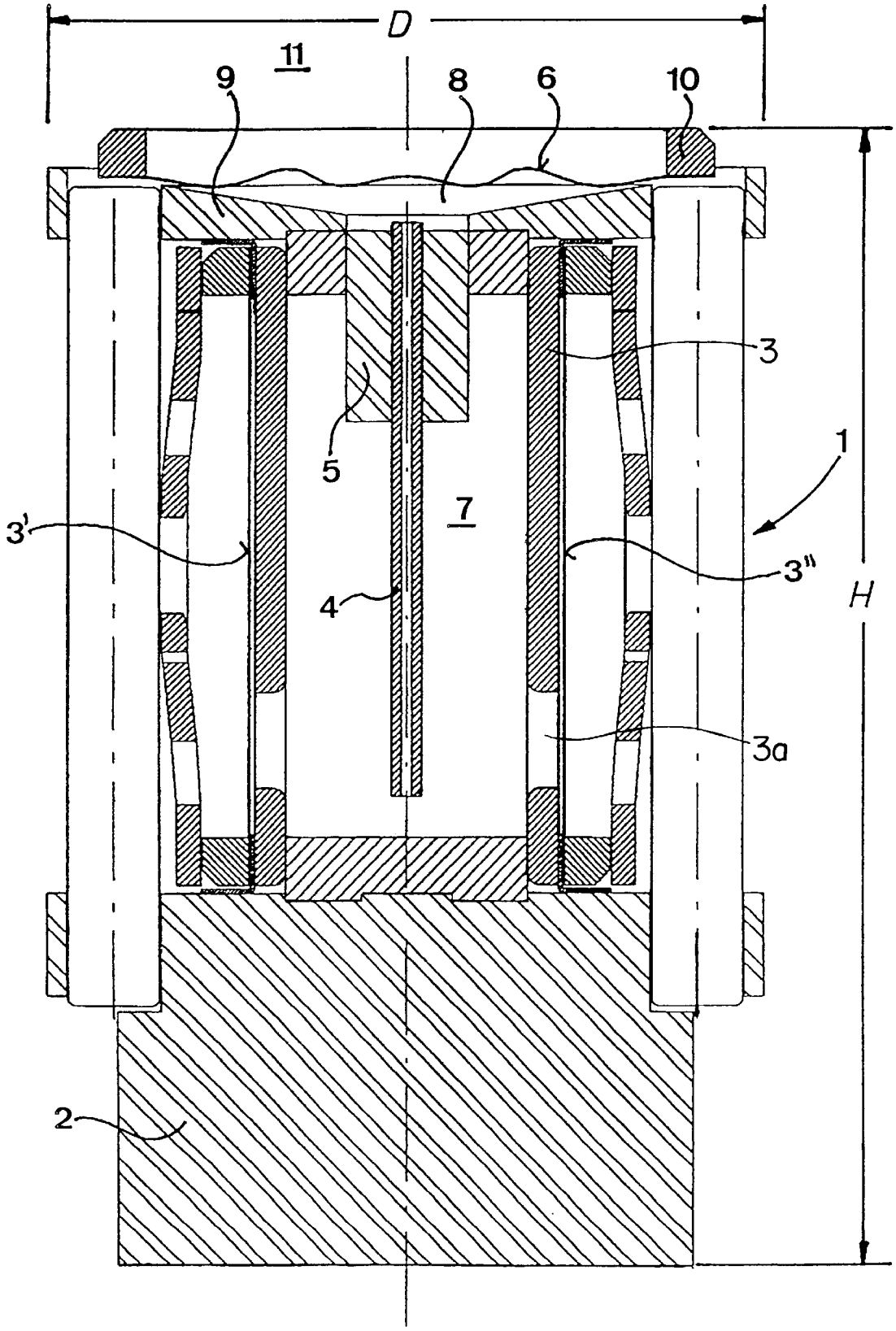
FIG. 1 shows a schematic axial section view of the micro-microphone according to the invention on a greatly enlarged scale.

The configuration of the microphone is represented in the drawing only to such an extent and will be explained in the following only to such an extent as is required for understanding the invention. Other parts, which are state-of-the-art and known to a person skilled in the art, do not require any further explanations.

In order to illustrate the size of the micro-microphone according to the invention, it should be mentioned that its length L is approximately 7 mm and its outer diameter D is approximately 4.5 mm.

As can be seen in the only drawing, the microphone, referred to in its entirety by reference numeral 1, is comprised substantially of a housing 2 having a housing mantle 3 with openings 3a that are covered by two membranes 3', 3". These membranes are mounted on the circumference of openings within the housing 2 in a seal tight manner so that an inner hollow space 7 is formed which is closed at all sides either by the membranes 3', 3" or the housing 2.

According to the invention, in the shown embodiment the end plate (end face) 9 of the housing 2 has arranged therein a pressure compensation tube 4 which has a high acoustic impedance as a result of its dimensions and its material so that it acts as a low-pass filter. In this way, it is ensured that the vibrations of the membranes 3+, 3" which are to be transmitted for the audible frequency range, are of too high a frequency to cause a noticeably pulsating flow of air from the inner hollow space 7 through the tube 4 into the compensation chamber 8.

The compensation chamber 8 in the shown embodiment is formed by a depression in the end plate 9 of the housing 2 and is sealed tightly relative to the ambient by the flaccid protective diaphragm 6. In order to mechanically protect the protective diaphragm 6, an annular component (ring member) 10 is provided at the end plate 9 which at the same time acts preferably also as a fastening element for the flaccid protective diaphragm 6.

The pressure compensation tube 4 is secured preferably by means of an insulator 5 to the end plate 9 in order to thus be vibration-technologically and acoustically neutral so that the acoustic properties of the microphone are affected as little as possible.

When a barometric pressure change occurs in the ambient 11 of the microphone, the flaccid diaphragm 6 will deform accordingly, for example, when the barometric pressure increases, it deforms in the direction toward the interior hollow space 7 until an equilibrium is reached due to the reduction of the total volume of the inner hollow space 7 and of the compensation volume of the chamber 8.

Since the flaccid protective diaphragm 6 counteracts such a deformation only with an elastic resistance that is as small as possible, this pressure compensation occurs substantially without deforming the membranes 3', 3" themselves or changing their tension.

In this way, the aforementioned goals are realized and a microphone is provided in which moisture entry and the resulting destruction or at least damage of a component are practically prevented.

The invention is, of course, not limited to the illustrated embodiment but can also be modified in many ways. For example, the inventive solution can also be used with microphones having only a single membrane. It is not necessary to employ a tube; instead, it is possible, as mentioned above, to employ another component of high acoustic impedance. Another option is a combination of such a component, for example, embodied as a foamed material, with a shorter tube.

Finally, it is also not required to arrange the compensation chamber 8 at the end face 9 of the microphone. It is also possible to position it at the side of the bottom plate of the microphone if it is possible to provide sufficient space for such a compensation chamber at this location where, of course, also the electrical signal lines are mounted. If this can be realized, such an arrangement at the bottom plate would be indeed desirable because this location is mechanically better protected.

While specific embodiments of the invention have been shown and described in detail to illustrate the inventive principles, it will be understood that the invention may be embodied otherwise without departing from such principles.

What is claimed is:

1. A micro-microphone for attachment to the clothing or directly to the body of a user, the micro-microphone comprising:

a housing having a housing mantle with a first end and a second end, an end plate connected to the first end, and a bottom plate connected to the second end;

the housing mantle having one or more openings;

one or more membranes positioned external to the housing mantle;

each one of the membranes configured to cover one of the openings of the housing mantle and thus defining an inner hollow space inside the housing;

a flaccid diaphragm connected externally to a portion of the housing and enclosing together with the portion of the housing a compensation chamber, wherein the flaccid diaphragm is configured to seal the compensation chamber moisture-tightly;

a component of high acoustic impedance configured to connect the inner hollow space inside the housing to the compensation chamber.

2. The micro-microphone according to claim 1, wherein the component of high acoustic impedance is a tube.

3. The micro-microphone according to claim 2, wherein the tube has an inner diameter of approximately 70 $\mu$m and a length of 3 to 4 mm.

4. The micro-microphone according to claim 2, wherein the tube is made of a corrosion-resistant material.

5. The micro-microphone according to claim 4, wherein the corrosion-resistant material is stainless steel or German silver.

6. The micro-microphone according to claim 4, wherein the corrosion-resistant material is a plastic.

7. The micro-microphone according to claim 1, wherein the component of high acoustic impedance is made of open-pore foamed material.

8. The micro-microphone according to claim 1, wherein the flaccid diaphragm is made of polycarbonate, polyurethane, rubber or an elastomer.

9. The micro-microphone according to claim 1, wherein the flaccid diaphragm is made of a metal foil.

10. The micro-microphone according to claim 1, further comprising a ring member configured to fasten the flaccid diaphragm to the end plate.

* * * * *